United States Patent [19]

Piscitelli et al.

[11] Patent Number: 4,493,527

[45] Date of Patent: Jan. 15, 1985

[54] SOCKET CONTACT FOR ELECTRICAL CONNECTORS

[75] Inventors: R. Amelia Piscitelli; Valentine J. Hemmer, both of Sidney; Eric F. Shepler, Bainbridge, all of N.Y.

[73] Assignee: The Bendix Corporation, Southfield, Mich.

[21] Appl. No.: 429,721

[22] Filed: Sep. 30, 1982

[51] Int. Cl.[3] ..... H01R 13/12

[52] U.S. Cl. ..... 339/258 R; 339/276 T

[58] Field of Search ..... 339/258 R, 258 P, 259 R, 339/262 R, 262 P, 276 T

[56] References Cited

U.S. PATENT DOCUMENTS 4,373,773 2/1983 Piscitelli et al. ..... 339/276 T 4,397,086 8/1983 Bickos et al. ..... 339/276 T

FOREIGN PATENT DOCUMENTS 2498823 7/1982 France ..... 339/276 T

*Primary Examiner*—Joseph H. McGlynn

*Attorney, Agent, or Firm*—R. J. Eifler

[57] ABSTRACT

A socket contact for electrical connectors consisting of a contact liner sleeve (16) with a rear sleeve (14) and inner and outer front sleeves (12, 10) assembled to the front and to the contact liner sleeve (16) with the outer sleeve (10) rear portion thereof formed over the rear face (40) of the inner front sleeve (12) to form a well defined retention shoulder (48).

1 Claim, 3 Drawing Figures

SOCKET CONTACT FOR ELECTRICAL CONNECTORS

The present invention relates to a socket contact for an electrical connector of the type consisting of a plurality of formed sheet metal sleeves. Socket contacts of the type adapted to be mated with pin contacts and electrical connectors have heretofore been constructed of a plurality of formed sheet metal sleeves as an alternative to machining such socket contacts from solid stock material.

U.S. Pat. No. 4,120,556 issued on Oct. 17, 1978 to Waldron et al for an "Electrical Contact Assembly" discloses a typical formed socket contact. Such socket contacts are normally installed in an electrical connector body, and one arrangement for securing the contacts within the electrical connector is an interengagement between a retainer and a retention shoulder on the socket contact. The retention shoulder location accurately positions the socket contact within the connector body, to provide proper mating engagement upon coupling of the electrical connector components.

Such socket contacts have, as described in the aforementioned U.S. patent, been constructed of three separate formed metal sleeves, i.e., an inner liner contact sleeve, which has a forward end portion with spring fingers adapted to engage the pin contact, and a rear portion with a terminal sleeve adapted to be crimped or otherwise connected to the electrical connector to be associated with the socket contact. In order to reinforce the contact liner sleeve, a rear sleeve is mounted over the terminal portion of the contact liner sleeve, and to protect the spring fingers, a hood sleeve is mounted over the forward portion of the contact liner.

In order to provide the retention shoulder a variety of techniques have heretofore been employed including the formation of a shoulder intermediate the length of the contact liner sleeve, the hood sleeve, or the rear sleeve or by the squaring of the rear face of the front sleeve. Difficulties are encountered with forming shoulders to provide the degree of squareness required for reliable engagement with the retaining tines and also in precisely locating the shoulder axially.

In some instances the end face of the hood or front sleeve is used as the retention shoulder and it is likewise difficult to form such sleeve with sufficient squareness to reliably engage the retainer tines. The retainer tines may thus slip underneath the front hood sleeve and in between the inside diameter of the hood sleeve and the contact liner sleeve which results in mispositioning of the socket contact upon assembly into the electrical connector.

The previously used machined contacts while providing a relatively rigid, accurately located and squared retention shoulder involved excessive cost, which is a substantial drawback, particularly in connector designs where a great number of such socket contacts are employed.

DISCLOSURE OF THE INVENTION

The present invention provides a precisely located retention shoulder which is sufficiently rigid and square offering an adequate engagement surface for the retainer tines in a socket contact of the formed metal type construction.

This is achieved by employing a two-piece front or hood sleeve in which a relatively heavy walled inner sleeve is surrounded with a relatively thin walled outer front sleeve. The inner sleeve is punched or otherwise secured to the contact liner sleeve with the relatively thin gage outer sleeve then assembled over the inner sleeve. The outer sleeve is of relatively greater length such that the rear portion thereof overhangs the end face of the inner front sleeve and the rear end is formed downward over the end face of the inner front sleeve providing an accurately located and rigid retention shoulder which has a more than adequate engagement face for reliable engagement by the retainer tines.

DETAILED DESCRIPTION

Figure 1:
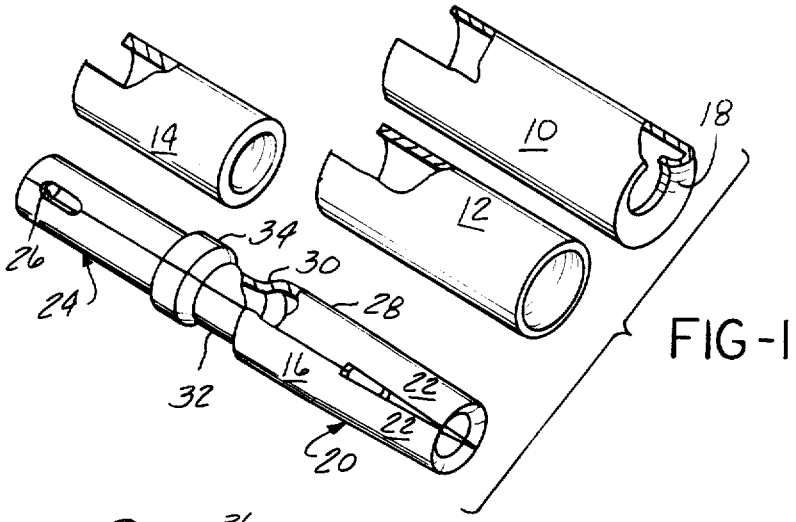
FIG. 1 is a perspective view of each of the component sleeves of a socket contact according to the present invention shown in partial section.

FIG. 1 illustrates the various sleeve components prior to their assembly together into the socket contact according to the present invention. This includes an outer front sleeve 10, inner front sleeve 12, a rear sleeve 14 and an elongated contact liner sleeve 16. The outer front sleeve 10 is formed from relatively thin gage sheet metal and may be of either formed or drawn construction and is of cylindrical shape with a front inwardly converging lip 18 acting to provide a guiding of the corresponding pin contact (not shown). The inside diameter of the outer front sleeve 10 is slidably received over the outside diameter of the inner front sleeve 12.

The inner front sleeve 12 is of either formed or drawn construction and of a relatively heavier gage metal than the relatively thin outer front sleeve 10. In its preassembled condition, the inner front sleeve 12 is a plain cylinder.

The rear sleeve 14 similarly may be of formed or drawn construction and is of straight cylindrical shape prior to assembly.

The contact liner sleeve 16 is generally cylindrical but includes a front portion 20 having spring fingers 22 converging to resiliently engage a pin contact upon insertion in the manner well known to those skilled in the art. The opposite or rear end forms a terminal portion 24 and has an internal diameter adapted to receive the bared end of an electrical conductor to be connected thereto with slots 26 provided to provide a uniform crimping action as is known to those skilled in the art. The front portion 20 has a cylindrical body section 28 adjacent to the spring fingers 22. The body section 28 ends in a shoulder 20 providing a transition to a smaller diameter section 32. The small diameter section 32 is intermediate the length of the contact liner sleeve 16 as is a shoulder 34 of larger diameter than either the terminal section portion 24 or the reduced diameter section 32.

Figure 2:
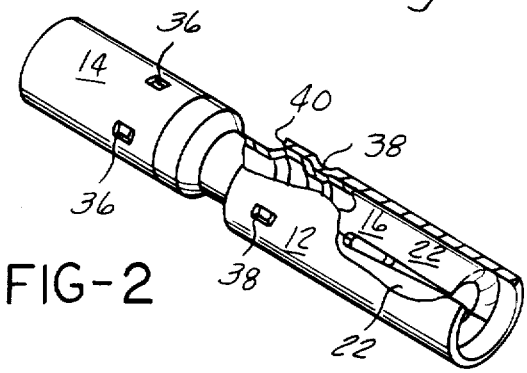
FIG. 2 is a perspective partially sectional view of a partially assembled socket contact according to the present invention.

FIG. 2 shows the first stage of assembly in which the rear sleeve 14 is placed over the terminal portion 24 of the contact liner sleeve 16 and lancing or prick punching at 36 carried out to join the rear sleeve 14 securely to the contact liner sleeve 16 with the forward face of the rear sleeve 14 in abutment against the shoulder 34. The inner front sleeve 10 is assembled with its inside diameter slidably fit over the body section 28 of the contact liner sleeve with prick punching 38 being carried out to stake or otherwise axially secure the inner front sleeve 12 to the contact liner sleeve 16. The end face 40 of the inner front sleeve 10 is located at the midsection of the contact liner sleeve 16 and approximately in registry with the shoulder 30 formed on the contact liner sleeve 16.

Figure 3:
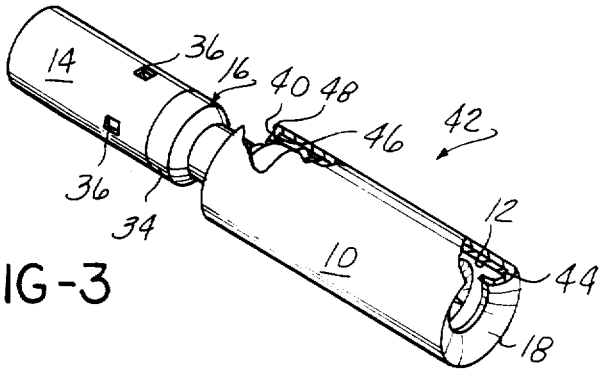
FIG. 3 is a perspective partially sectional view of a completed socket contact assembly according to the present invention.

FIG. 3 shows the final assembly of the socket contact 42 in which the outer front sleeve 10 is assembled over the inner front sleeve 12 with the forward face in abutment against the inside surface of the converging lip 18. The rear end 46 of the outer front sleeve 10 is of sufficient length such that in position with the front face 44 in abutment with the interior inside surface of lip 18, there is an extension over the end face 40 of the inner front sleeve 12.

In the final stage of assembly the end 46 is formed over the end face 40 to provide a rear facing shoulder 48 located at the midsection of the contact 10 which may act as a retention feature or shoulder for assembly of the socket contact 42 into an electrical connector.

Accordingly, it can be appreciated that the retention shoulder so formed offers a relatively great radial area with squareness to the axis of the socket contact for reliable engagement by the retainer tines and that it may be accurately located. The entire socket contact components are securely and accurately located and joined to one another to provide a relatively precision, rigid assembly notwithstanding its construction of formed or drawn sheet metal components.

We claim:

1. A socket contact for electrical connectors comprising an elongate formed metal contact liner sleeve having a front contact portion and a rear terminal portion, each of said portions located on a respective side of a midsection, a formed metal rear sleeve mounted over said terminal portion and secured thereto and a formed metal outer front sleeve mounted over said contact portion secured thereto and having a rear end adjacent the midsection of said contact liner sleeve characterized by an inner front sleeve mounted within said outer front sleeve having a greater wall thickness and of a shorter length than said outer front sleeve to form a rear facing end adjacent the midsection of said contact liner sleeve, said outer front sleeve having the rear end thereof formed over the rear facing end of said inner front sleeve to form a retention shoulder at the midsection of the socket contact.

* * * * *